United States Patent [19]

Smrt

[11] Patent Number: 4,943,008

[45] Date of Patent: Jul. 24, 1990

[54] CHASSIS ASSEMBLY FOR SPRAYING APPARATUS

[75] Inventor: Thomas J. Smrt, Cary, Ill.

[73] Assignee: Fox Valley Systems, Inc., Cary, Ill.

[21] Appl. No.: 331,267

[22] Filed: Mar. 30, 1989

[51] Int. Cl.[5] ..... B05B 1/28; B05B 9/04; E01C 23/16

[52] U.S. Cl. ..... 239/754; 239/150; 239/176; 239/397

[58] Field of Search ..... 239/150, 722, 754, 288–288.5, 239/176, 578, 390, 391, 397

[56] References Cited

U.S. PATENT DOCUMENTS

| | | | |
|---|---|---|---|
| 3,796,353 | 3/1974 | Smrt | 234/150 |
| 4,262,821 | 4/1981 | Smrt | 239/172 |
| 4,545,531 | 10/1985 | Williams | 239/150 |
| 4,599,968 | 7/1986 | Ryder et al. | 239/176 |
| 4,641,780 | 2/1987 | Smrt | 239/150 |

*Primary Examiner*—Andres Kashnikow
*Assistant Examiner*—Karen B. Merritt
*Attorney, Agent, or Firm*—Leydig, Voit & Mayer

[57] ABSTRACT

A chassis assembly for a moveable spraying apparatus supports a container which contains material such as paint and a handle assembly for controlling the apparatus. This chassis includes a housing with a support beam which supports the handle assembly within the housing and at the side of it. It also includes a wind screen for shielding the discharged material from the wind, can holders for receiving spent and unused containers, and an indicator for maintaining the apparatus along a predetermined path.

11 Claims, 2 Drawing Sheets

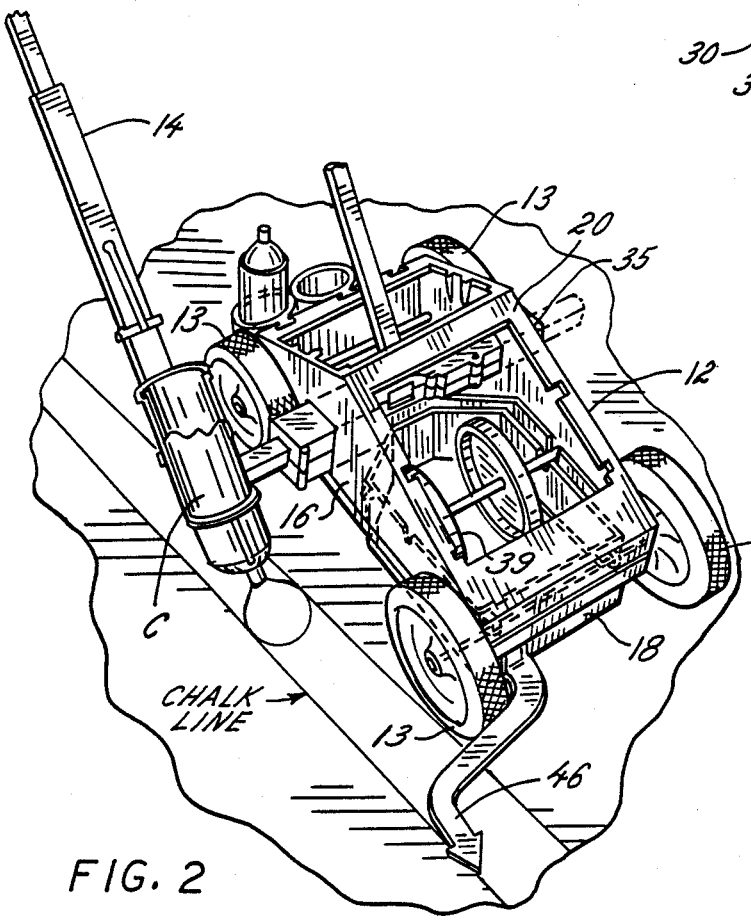
FIG. 2
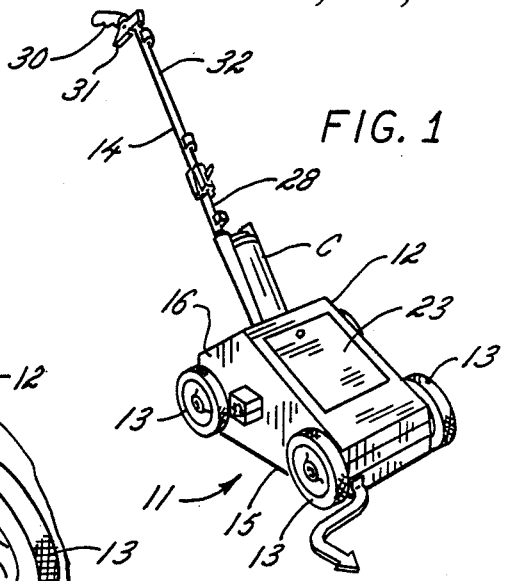
FIG. 1
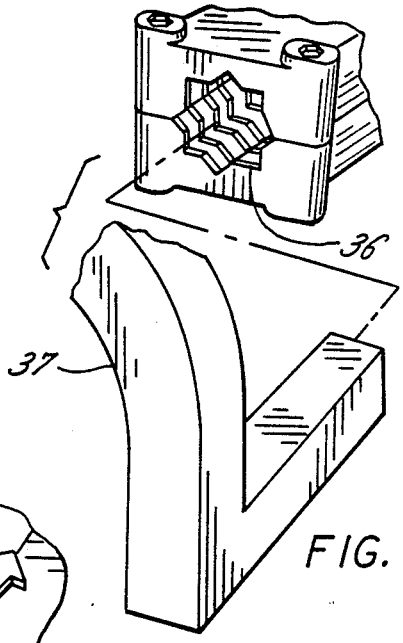
FIG. 4
FIG. 3
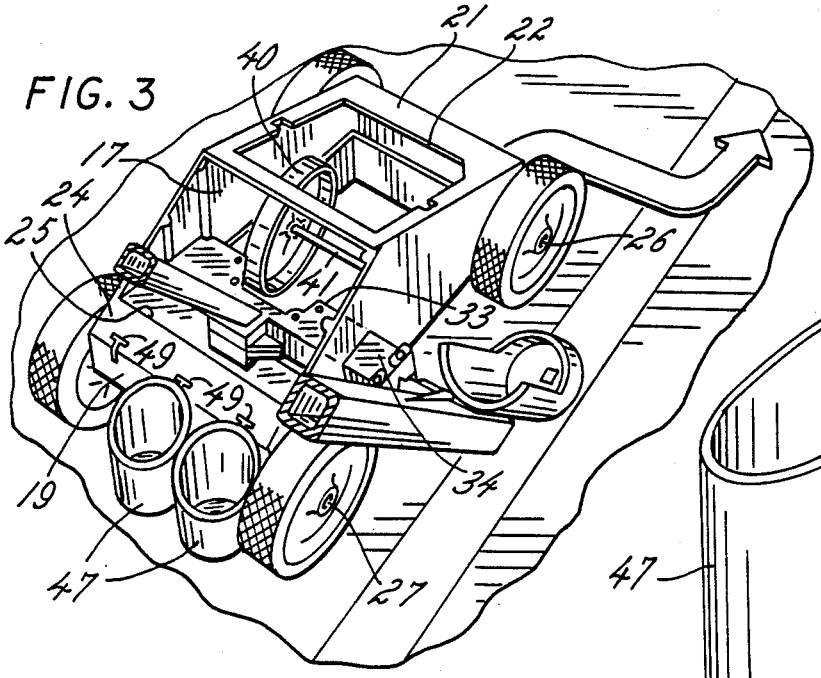
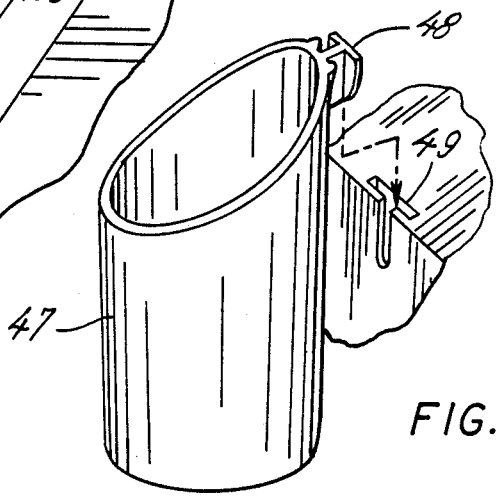
FIG. 5

FIG. 6
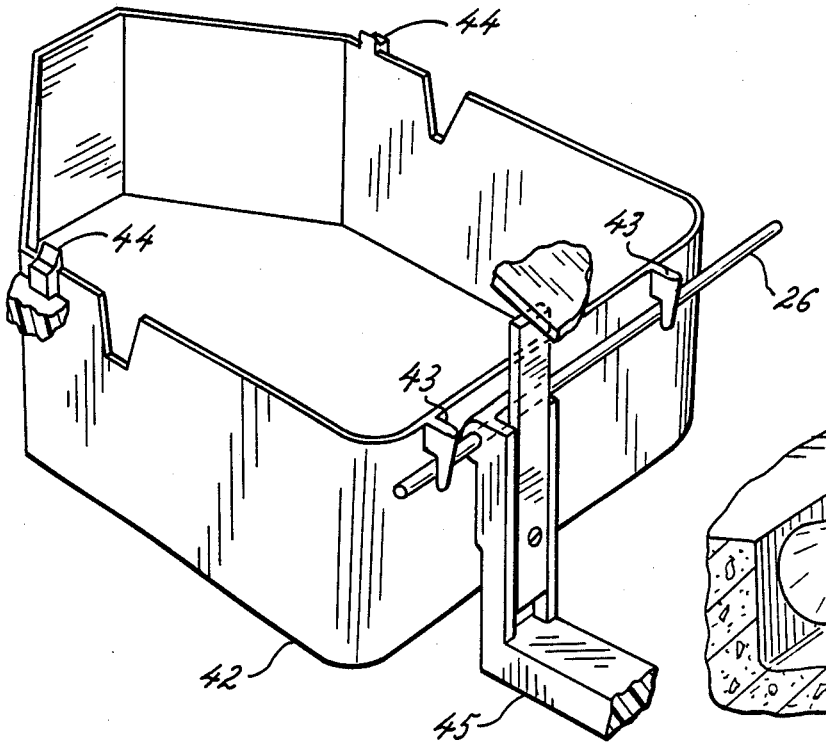
FIG. 7
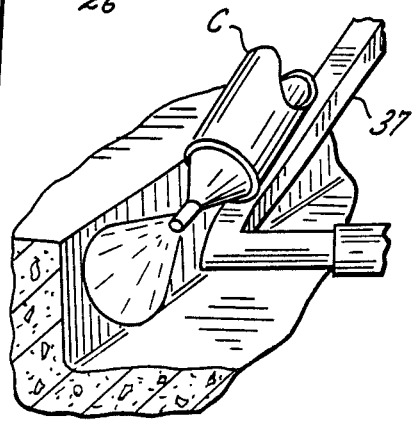
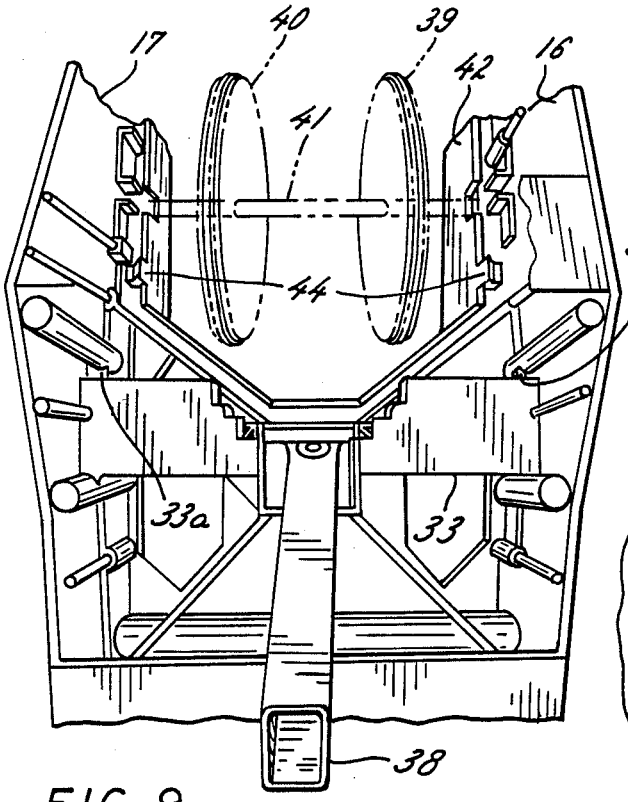
FIG. 9
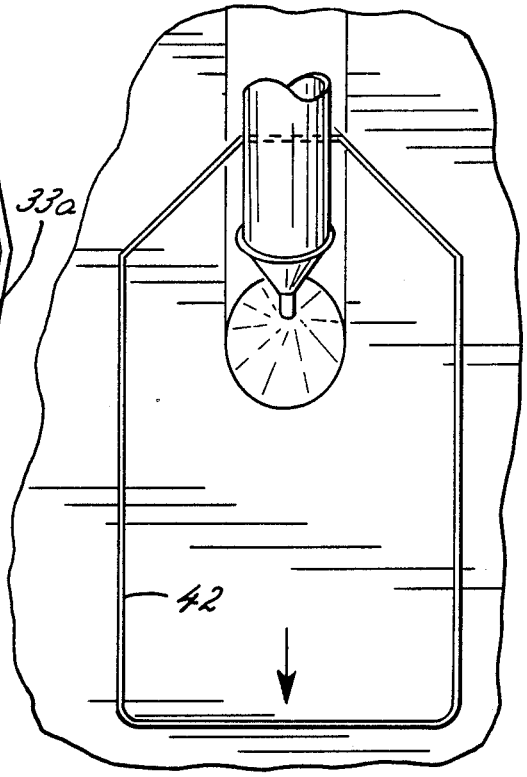
FIG 8 PLAN VIEW, WINDSCREEN

CHASSIS ASSEMBLY FOR SPRAYING APPARATUS

BACKGROUND OF THE INVENTION

1. Field Of The Invention

The present invention relates generally to a chassis assembly for a moveable spraying apparatus which applies marks such as stripes to a surface, and more particularly to a chassis assembly which has a number of novel features, including one for allowing a user to mark the surface along the side of the spraying apparatus.

2. Description Of The Prior Art

This invention is an improvement over the spraying apparatus described in U.S. Pat. No. 4,641,780 issued to Thomas Smrt on Feb. 10, 1987. The apparatus described in that patent includes a chassis; wheels rotatably mounted to the chassis for engaging a supporting surface and rolling on the supporting surface to allow easy movement of the chassis; and a handle assembly secured to the chassis for controlling the apparatus and activating an aerosol spray can. The chassis has an open bottom, and the aerosol spray can or other container discharges its contents through the open bottom onto the subtending surface.

The handle assembly extends into the housing between the wheels of the apparatus where it activates the aerosol spray can to discharge its contents onto the surface. This apparatus easily marks an open surface area; however, it cannot mark areas next to obstructions, e.g., a wall or curb. The chassis assembly of the present invention does allow the spraying apparatus to provide marks on a surface disposed adjacent an obstruction. It is a simple construction which minimizes the expense of manufacture and assembly and performs reliably.

SUMMARY OF THE INVENTION

In accordance with one embodiment of this invention, the chassis of the spraying apparatus includes a housing with a front and rear wall, two side walls and an open bottom. The wheels support the chassis and allow a user to move it along a supporting surface. The wheels lie rotatably mounted to the chassis and include two front wheels disposed on opposite ends of a front axle and two rear wheels disposed on opposite ends of a rear axle. Each axle extends across the chassis through suitably sized openings formed in the side walls.

The chassis also includes a support beam disposed between the two axles and parallel to them. This beam extends through suitably sized openings in the side walls; and it includes end portions which extend outward of the side walls. It also includes an opening formed longitudinally through the middle of at least one of its end portions. This opening receives an end portion of a post which supports a handle assembly of the spraying apparatus. A user may releasably secure the handle assembly to this post, outward of the chassis, or inside the housing on a post secured to the beam with a bracket.

The chassis also includes a wind screen disposed within the walls of the chassis for shielding the discharge of paint or other material from wind interference. This screen is a continuous strip with an open top and an open bottom. It includes hook segments which engage the front axle and protuberances on the walls of the housing to maintain the shield in a predetermined position within the walls.

An indicator slidably mounted on the front axle has a sinuous configuration and extends outward of the housing and to the side of it. It has an end portion with a shape of an arrow which points in the direction of movement of the apparatus. One may move this indicator along the length of the front axle and align it with a chalk line or other such mark which facilitates maintaining the apparatus along a predetermined path.

At least one can holder releasably secured to the rear wall of the housing provides support for spent or unused aerosol cans. The can holder has the shape of a cup; and it includes a hook which extends into openings formed into the rear wall of the housing. Thus, the rear wall supports the holder. The holder as well as all the other elements of the chassis are molded plastic components of high strength and rigidity. Alternatively, one may form these elements out of metal.

BRIEF DESCRIPTION OF THE DRAWINGS

For a more complete understanding of this invention, one should now refer to the embodiment illustrated in greater detail in the accompanying drawings and described below by way of an example of the invention. In the drawings:

FIG. 1 is a perspective view of a spraying apparatus embodying the present invention.

FIG. 2 is an enlarged perspective view of the spraying apparatus of the present invention, showing the chassis assembly and the handle assembly disposed on the side of the apparatus, outward of the chassis.

FIG. 3 is a rear perspective view of the spraying apparatus shown in FIG. 2.

FIG. 4 is a perspective view of the support beam used in the chassis and a post which it receives.

FIG. 5 is a perspective view of one of the can holders used to store aerosol cans on the chassis.

FIG. 6 is a perspective view of the wind shield and indicator forming part of the chassis.

FIG. 7 is a perspective view of the side post and an aerosol spray can.

FIG. 8 is a plan view of the wind shield shown in FIG. 6.

FIG. 9 is a partial, top perspective view of the inside of the chassis of the present invention.

While the following text describes the invention in connection with a preferred embodiment, one should understand that the invention is not limited to this embodiment. Furthermore, one should understand that the drawings are not necessarily to scale. In certain instances, the applicant may have omitted details which are not necessary for an understanding of the present invention.

DETAILED DESCRIPTION OF THE DRAWINGS AND AN EMBODIMENT

Turning now to the drawings, FIGS. 1 and 2 show the spraying apparatus of the present invention at 11. This apparatus generally includes a chassis 12, four wheels 13 rotatably mounted on the chassis 12, and a handle assembly 14. The chassis includes a box-like housing 15 with sidewalls 16 and 17, a front wall 18 and a rear wall 19. This housing 15 also includes an inclined top 20 formed by a front portion 21 defining an opening 22 and a door 23 for closing the opening and a rear portion 24 defining an opening 25 through which the handle assembly 14 extends into the housing 15.

The wheels 13 support the chassis 12 and lie rotatably mounted to the housing 15. These wheels include two front wheels mounted on opposite ends of a front axle 26 and two rear wheels mounted on opposite ends of a rear axle 27. Each axle 26 and 27 extends across the housing 12 through a suitably sized opening formed in the sidewalls 16 and 17 of the housing. The wheels 13 engage a subtending support surface and allow the user to move the apparatus over the surface.

The handle assembly 14 allows a user to control the apparatus and a container C, e.g., an aerosol spray can, to discharge the contents of the container onto the surface. It includes a rod member 28 releasably secured at one end to the chassis 12 as described below. This rod member supports a holder 29 for the container C, a handle grip 30 and trigger 31 disposed at the end opposite the one secured to the chassis 12 and a linkage assembly 32 connecting the trigger 24 with the holder 29. The holder 29 includes an opening at one end through which the nozzle of the spray can extends.

A user may actuate the nozzle using the linkage assembly 32 and the trigger 31 and apply a layer of paint to the supporting surface below the nozzle. (U.S. Pat. No. 4,262,821 issued to Thomas Smrt on Apr. 21, 1981 describes the handle assembly 14 in greater detail; and the applicant incorporates its disclosure to the present description by this reference.)

Referring now to FIGS. 2–4 and 9, the chassis 12 includes an elongate support beam 33 for supporting the handle assembly 14. This beam lies between the axles 26 and 27 and parallel to them. It extends through the openings in the side walls 16 and 17. Stop segments 33a (See FIG. 9) on the beam engage the inside of the sidewalls 16 and 17 and prevent the beam from sliding out of the position shown in FIGS. 2 and 3. One of its end portions 34 extends outward of the sidewall 16 as a cantilever; and the other opposite end portion 35 extends outward of the sidewall 17.

The beam 33 comprises two half segments fixedly secured together to define an opening 36 which extends through the center of the end portion 34. This opening 36 receives an end segment of a post 37 to which a user releasably secures the handle assembly 14. The shape of the opening allows a user to adjust the angle between the post 37, and accordingly, the handle assembly 14, and the supporting surface. The other end portion 35 of the beam 33 also has an opening (not shown) for receiving the post 37 at the opposite side of the apparatus.

As shown in FIG. 2, the post 37 allows the user to place the handle assembly 14 and the aerosol spray can outward of the housing and mark the surface along the side of the apparatus. The beam 33 also supports a post 38 at its midsection (See FIGS. 3 and 9). It receives one end of the post in an opening which extends downward from the top of the beam toward the supporting surface. This post 38 allows the user to releasably secure the handle assembly 14 at the center of the apparatus and to mark the surface by discharging the contents of the container C through the bottom of the apparatus. A pair of discs 39 and 40 disposed on an axle 41 and rotatably mounted to the housing 15 provide sharp edges for the discharging material.

To shield the discharge of the container C at the discs 39 and 40 from wind interference, the chassis 12 includes a shield 42 disposed around the discs and releasably mounted to the chassis (See FIGS. 6 and 8). This shield 42 is a continuous plastic strip, open at its top and bottom. It includes two hook segments 43 which releasably mount its front end to the front axle 26 and two hooks 44 which releasably mount the rear of the shield on top of protuberances or shelves formed on the inside of the sidewalls 16 and 17.

An indicator 45 slidably mounted on the front axle 26 has a sinuous configuration and extends outward of the housing and to the side. It has an end portion 46 (See FIG. 2) with a shape of an arrow which points in the direction of movement of the apparatus. One may move this indicator 46 along the length of the front axle 26 and align it with a chalk line or other such marking which facilitates maintaining the apparatus along a predetermined course.

One or more can holders 47 releasably secured to the rear wall 19 provides support for spent or unused aerosol cans (See FIGS. 2, 3 and 5). The can holder 47 has the shape of a cup; and it includes a hook 48 which extends into openings 49 formed into the rear wall of the housing 15. Thus, the rear wall 19 supports the holders 47. The holder 47 as well as all the other elements of the chassis are molded plastic components of high strength and rigidity. Alternatively, one may form these elements out of metal.

Thus, the applicant has provided a chassis assembly for a spraying apparatus which has a number of novel features, including one for allowing a user to mark the surface along the side of the spraying apparatus. While the applicant has shown only one embodiment of the invention, one will understand, of course, that the invention is not limited to this embodiment since those skilled in the art to which the invention pertains may make modifications or other embodiments of the principles of this invention, particularly upon considering the foregoing teachings. Therefore, by the appended claims, the applicant intends to cover any such modifications or other embodiments which incorporate those features which constitute the essential features of this invention.

What is claimed is:

1. A movable spraying apparatus for marking a surface over which the apparatus moves, said apparatus comprising:

chassis means for supporting a container which contains material which the apparatus discharges onto the surface to make a mark, said chassis means comprising: a housing and a beam member secured to said housing, said beam member having a first segment disposed in said housing and a second segment disposed outward of said housing as a cantilever;

wheel means rotatably mounted to said chassis means for supporting said chassis means and allowing a user to move the apparatus over the surface; and handle means adapted for being selectively and releasably secured to said first or second segment of said beam member for controlling said apparatus and the container to discharge material from the container onto the surface in a predetermined pattern.

2. The spraying apparatus of claim 1, wherein said handle means is secured to the second segment of said beam member.

3. The spraying apparatus of claim 1, wherein said housing of said chassis means is box-like with a front segment, a rear segment, sand two side segments, one of said side segments defining an opening and said beam member extending outward of said housing through said opening.

4. The spraying apparatus of claim 1, wherein said chassis means includes a screen member releasably secured to said housing, said screen member shielding the discharge of material out of said container from wind.

5. The spraying apparatus of claim 1, wherein said chassis means includes at least one holder releasably secured to said housing for holding spent or unused containers.

6. A chassis assembly for a movable spraying apparatus which moves on a plurality of wheels and marks a surface over which it moves, said chassis assembly comprising: a housing supported by said wheels; and a beam member secured to said housing, said beam member comprising a first segment disposed in said housing and a second segment disposed outward of said housing as a cantilever and being adapted for supporting a handle assembly and a container which contains material which is discharged onto the surface to mark the surface, said handle assembly being adapted for being selectively and releasably secured to said first or second segment of said beam member.

7. The spraying apparatus of claim 6, wherein said handle means is secured to the second segment of said beam member.

8. The spraying apparatus of claim 6, wherein said housing of said chassis means is box-like with a front segment, a rear segment, and two side segments, one of said side segments defining an opening and said beam member extending outward of said housing through said opening.

9. The spraying apparatus of claim 6, wherein said chassis means includes a screen member releasably secured to said housing, said screen member shielding the discharge of material out of said container from wind.

10. The spraying apparatus of claim 6, wherein said chassis means includes at least one holder releasably secured to said housing for holding spent or unused containers.

11. A movable spraying apparatus for marking a surface over which the apparatus moves, said apparatus comprising:

chassis means for supporting a container which contains material which the apparatus discharges onto the surface to make a mark, said chassis means including: a housing and a beam member secured to said housing, said beam member being disposed outward of said housing;

wheel means rotatably mounted to said chassis means for supporting said chassis means and allowing a user to move the apparatus over the surface; and handle means releasably secured to said beam member for controlling said apparatus and the container to discharge material from the container onto the surface in a predetermined pattern.

* * * * *